US009523505B2

(12) United States Patent
Ashmore

(10) Patent No.: US 9,523,505 B2
(45) Date of Patent: Dec. 20, 2016

(54) COMBUSTION APPARATUS

(75) Inventor: David Owen Ashmore, Shipston-on-Stour (GB)

(73) Assignee: Landy Vent UK Limited, Studley, Warwickshire (GB)

( * ) Notice: Subject to any disclaimer, the term of this patent is extended or adjusted under 35 U.S.C. 154(b) by 873 days.

(21) Appl. No.: 12/695,311

(22) Filed: Jan. 28, 2010

(65) Prior Publication Data

US 2010/0192934 A1 Aug. 5, 2010

(30) Foreign Application Priority Data

Jan. 31, 2009 (GB) ..... 0901688.2
Sep. 3, 2009 (GB) ..... 0915318.0

(51) Int. Cl.
*F24C 1/14* (2006.01)
*F24B 1/195* (2006.01)
*F24B 1/24* (2006.01)

(52) U.S. Cl.
CPC *F24B 1/195* (2013.01); *F24B 1/24* (2013.01)

(58) Field of Classification Search
CPC ..... F24B 1/24; F24B 1/195
USPC ..... 126/77, 151
See application file for complete search history.

(56) References Cited

U.S. PATENT DOCUMENTS 1,816,110 A * 7/1931 Cannon ..... 122/18.3
2,101,509 A 12/1937 Rasanen
2,671,440 A * 3/1954 Dupler ..... 126/512
2,676,583 A * 4/1954 Blumson ..... 126/76
3,895,219 A * 7/1975 Richerson et al. ..... 219/553
4,466,420 A * 8/1984 Ernisse et al. ..... 126/509
4,611,572 A 9/1986 Martenson
4,766,876 A * 8/1988 Henry et al. ..... 126/77
5,263,471 A * 11/1993 Shimek et al. ..... 126/528
5,333,601 A 8/1994 Hill
5,893,358 A * 4/1999 Whitfield ..... 126/73
6,213,116 B1 * 4/2001 Swainson ..... 126/76
6,425,754 B1 * 7/2002 Lindskog ..... 431/5
6,595,199 B1 * 7/2003 Andersen et al. ..... 126/77
2008/0234123 A1 9/2008 Patil et al.
2009/0188485 A1 7/2009 Ferguson et al.

FOREIGN PATENT DOCUMENTS

CN 2147434 Y 11/1993
EP 1018621 A2 12/1999
(Continued)

OTHER PUBLICATIONS

Search Report performed by the Great Britain Intellectual Property Office for Application No. GB1001428.0, dated Apr. 6, 2010.

*Primary Examiner* — Gregory Huson
*Assistant Examiner* — Aaron Heyamoto
(74) *Attorney, Agent, or Firm* — Bishop Diehl & Lee, Ltd.

(57) ABSTRACT

Combustion apparatus for use with a solid fuel has a firebox constructed at least in part of a fired refractory carbide material. The fired refractory carbide material has a catalytic effect on the combustion process providing a cleaner and more efficient combustion. The fired refractory material also absorbs heat from the combustion process directly or indirectly by heat exchange with combustion products and dissipates the absorbed heat over an extended period of time providing space heating after the combustion process is completed.

16 Claims, 11 Drawing Sheets

(56) References Cited

FOREIGN PATENT DOCUMENTS

| | | | |
|---|---|---|---|
| GB | 117964 | | 8/1918 |
| GB | 2431985 | A | 5/2007 |
| GB | 2467433 | B | 8/2010 |
| WO | 8604665 | | 8/1986 |
| WO | 2005100861 | A1 | 10/2005 |
| WO | 2009/072875 | A1 | 6/2009 |

* cited by examiner

COMBUSTION APPARATUS

CROSS-REFERENCE TO RELATED APPLICATIONS

This application claims the benefit of Great Britain Patent Application Serial No. GB 0901688.2 filed on Jan. 31, 2009, and Great Britain Patent Application No. GB 0915318.0, filed Sep. 3, 2009.

TECHNICAL FIELD OF THE INVENTION

This invention relates to combustion apparatus for space heating. The invention has particular, but not exclusive, application to combustion apparatus for use with solid fuels including, but not limited to wood, coal and the like combustible materials.

As used herein the term "solid fuel" includes natural fuel sources such as wood or coal and recycled fuel sources such as compressed blocks of sawdust and coaldust as well as other forms of substitute materials such as wood derived biomass fuel.

BACKGROUND OF THE INVENTION

In the known solid fuel stoves, combustible material is burned in a fire box to provide a heat source for heating the surrounding area by radiation from the body of the stove which is typically made of a metal such as cast iron or steel. Metal is rapidly heated by the combustion products and is a good radiator of heat. However, the metal is also rapidly cooled when solid fuel is not being burned in the stove. As a result, heating is in the main only effective while solid fuel is being burned in the stove.

SUMMARY OF THE INVENTION

The present invention has been made from a consideration of the foregoing.

The present invention preferably seeks to mitigate the aforementioned disadvantages of the known stoves.

According to a first aspect of the invention, there is provided combustion apparatus comprising a stove having a firebox of fired refractory material for burning solid fuel.

Preferably, the fired refractory material is a fired refractory carbide material. The carbide material is preferably silicon carbide although other carbide materials may be employed.

Preferably, the fired refractory material includes at least 40% by weight silicon carbide, still more preferably at least 50% by weight silicon carbide and most preferably at least 60% by weight silicon carbide. The fired refractory material may include up to 90% by weight silicon carbide.

We have found that using silicon carbide has a number of unexpected benefits. For example, we have found that the silicon carbide results in better and cleaner combustion.

Thus, we have found that the silicon carbide allows very high combustion temperatures to be achieved, typically 900-1000° C., and has a catalytic effect on the combustion of the solid fuel, typically starting when the outer body temperature reaches 150° C.

As a result, the solid fuel is substantially completely combusted at the higher temperatures achievable leaving no deposits on the walls of the firebox.

In addition, volatile elements in the combustion products may be consumed before discharge to atmosphere keeping down the release of pollutants.

In tests we have found that efficiency of up to 85.3% with a carbon output to atmosphere of 0.29% may be obtained.

We have also found that the silicon carbide results in better extraction and dissipation of heat.

Thus, we have found that the silicon carbide has an affinity to absorb heat and release it slowly so that heat is dissipated more evenly and for a longer period of time over a wider area so that localised overheating of the room in which the stove stands may be reduced.

We have found that when the stove is running, the outer body mass temperature is typically of the order of 200° C. compared to a traditional steel or cast iron stove which could have an outer body mass temperature of 500-600° C.

The improved heat extraction has the added benefit that the temperature of the combustion products discharged to atmosphere may be lower, for example 80-100° C., compared to a traditional steel or cast iron stove.

The slower heat dissipation has the added benefit that the stove can continue to release heat even when the combustion process is completed and can radiate heat over a longer period of time when the combustion process is completed compared to a traditional steel or cat iron stove.

As a result, we have found that the stove can release up to 25% of the absorbed heat seven hours after running up to temperature and even a lower heat release may be capable of keeping a well insulated building up to temperature twelve hours later.

Preferably, the combustion products are further combusted before passing to a flue for discharge to atmosphere. Such further combustion may be effected by the addition of secondary air to the combustion chamber.

One or more baffles may be employed within the combustion chamber for directing the flow of secondary air to mix with and re-combust the hot combustion products.

Such re-combustion of the combustion products may further improve efficiency by contributing to the overall body mass temperature of the stove and/or may reduce the amount of pollutants such as volatile elements and toxic gases contained in the combustion products discharged to atmosphere.

Preferably, the body of the stove is heated by the combustion process and by heat extracted from the combustion products. Preferably substantially the whole body of the stove is made of fired refractory material, preferably the same material used for the firebox.

Preferably, the body mass of the stove provides a source of radiated heat from the surface of the stove. The body mass of the stove may also provide a source of convected heat by heat exchange with air flowing over the outer surface of the stove.

The outer surface of the stove may be configured to enhance heat exchange with the air. For example, the surface may be profiled to increase the area exposed to the air. Alternatively or additionally, one or more flow passageways may be provided within the body for air to flow through and be heated.

Preferably, the body mass of the stove provides a source of heat for heating a heat exchange fluid via ducting fitted to a heat exchange unit located within a part of the body of the stove outside the combustion chamber so that combustion efficiency is not materially affected. For example, the heat exchange unit may comprise a refractory carbide "hot box" fitted to the stove.

Thus, the body mass may be used to heat air to provide a supply of warm air for space heating in the room of a building in which the stove stands or in other parts of the building.

Alternatively or additionally, the body mass may be used to heat water to provide a supply of hot water for washing or space heating, for example hot water circulating in a hot water or central heating system.

The heat extracted in this way may add to the overall heat output of the stove so as to improve further heating efficiency of the stove.

In another arrangement, the heat exchange fluid may be heated by heat exchange with the combustion products, preferably within the body mass of the stove.

According to another aspect of the present invention, there is provided combustion apparatus for a solid fuel comprising a stove including baffling for mixing air with combustion products within a combustion chamber.

The baffling may be configured to direct the flow of air to mix with the combustion products towards the lower end and/or the upper end of the combustion chamber.

The apparatus may comprise any of the features of the previous aspect of the invention.

According to yet another aspect of the present invention, there is provided combustion apparatus for a solid fuel comprising a stove configured to provide a source of radiated heat and a source of heat for heating a heat exchange fluid.

The radiated heat may be provided by the body mass of the stove and the heat exchange fluid, for example air and/or water, may be heated within the body mass.

The apparatus may comprise any of the features of the previous aspects of the invention.

According to a further aspect of the present invention, there is provided combustion apparatus for a solid fuel comprising a stove having a combustion chamber defined at least in part by a fired refractory carbide material.

The fired refractory carbide material is preferably silicon carbide present in an amount from 40% to 90% by weight, more preferably at least 50% and most preferably at least 60% by weight.

Preferably, the combustion chamber has one or more walls of fired refractory carbide material. The walls preferably provide a firebox.

The apparatus may comprise any of the features of the previous aspects of the invention.

According to a still further aspect of the present invention, there is provided a method of increasing heat extraction from combustion apparatus for a solid fuel by the use of a fired refractory carbide material.

Preferably, the fired refractory carbide material includes silicon carbide.

Preferably, the fired refractory carbide material includes at least 40% by weight silicon carbide, more preferably at least 50% by weight silicon carbide, still more preferably at least 60% by weight silicon carbide and may include up to 90% by weight silicon carbide.

The method may comprise any of the features of the previous aspects of the invention.

According to a yet further aspect of the present invention, there is provided a method of increasing heat extraction from combustion apparatus for a solid fuel by providing baffling for secondary combustion of combustion products with air within a combustion chamber.

The baffling may be configured to direct the flow of air to mix with the combustion products towards the lower end and/or the upper end of the combustion chamber.

The method may comprise any of the features of the previous aspects of the invention.

According to still another aspect of the present invention, there is provided a method of increasing heat extraction from combustion apparatus for a solid fuel by configuring the apparatus as a source of both radiated heat and heat for heating a heat exchange fluid.

The radiated heat may be provided by the body mass of the stove and the heat exchange fluid, for example air and/or water, may be heated within the body mass.

The method may comprise any of the features of the previous aspects of the invention.

According to still another aspect of the present invention, there is provided a method of combusting a solid fuel employing combustion apparatus having a combustion chamber defined at least in part by a fired refractory carbide material.

Preferably, the fired refractory carbide material forms at least one wall or surface of the combustion chamber.

The method may comprise any of the features of the previous aspects of the invention.

Exemplary embodiments of the invention will now be described in more detail by way of example only with reference to the accompanying drawings in which like reference numerals are used throughout to indicate the same or similar parts.

DETAILED DESCRIPTION OF THE EXEMPLARY EMBODIMENTS

Figure 1:
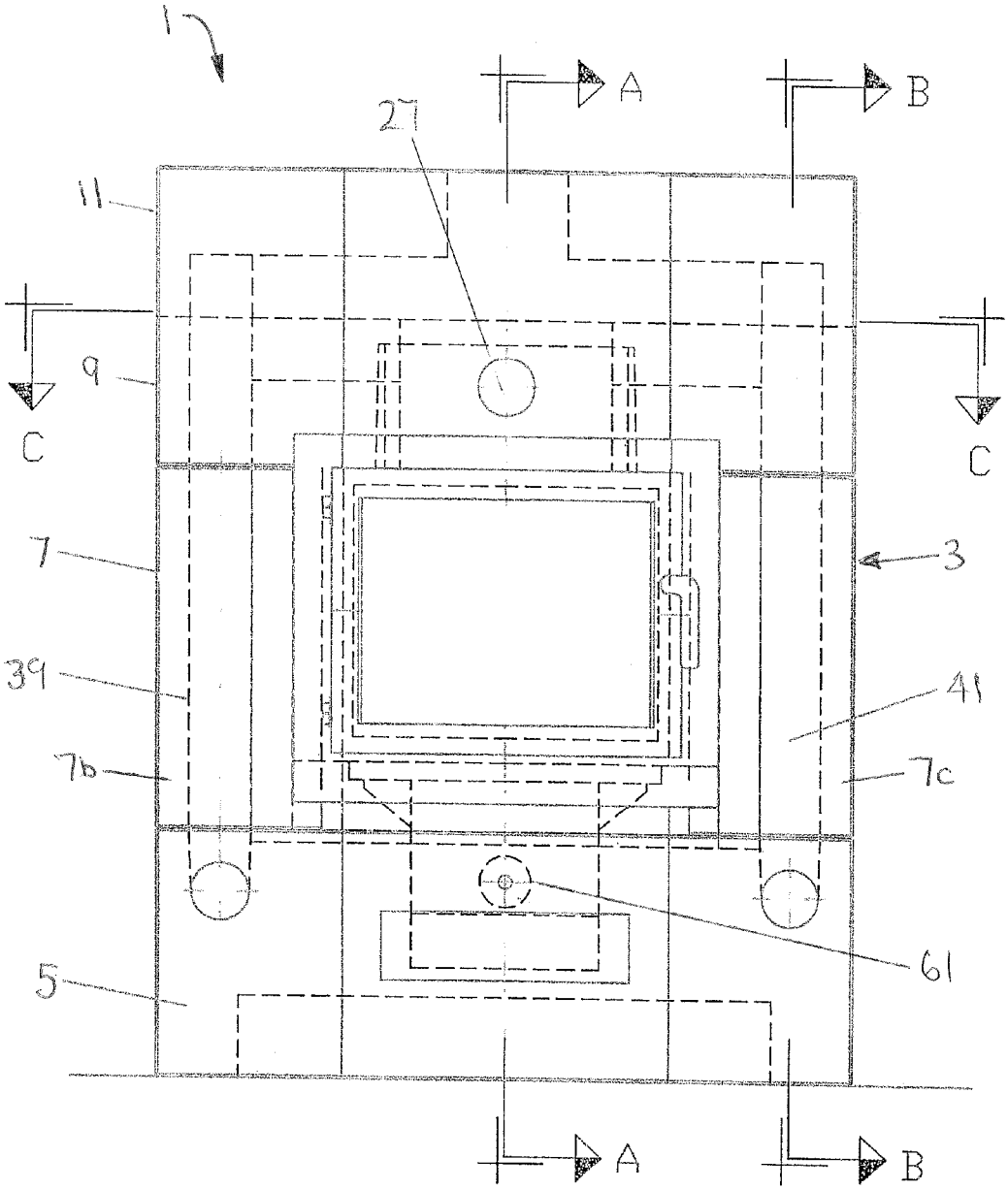
FIG. 1 is a front view of combustion apparatus embodying the invention.
Figure 2:
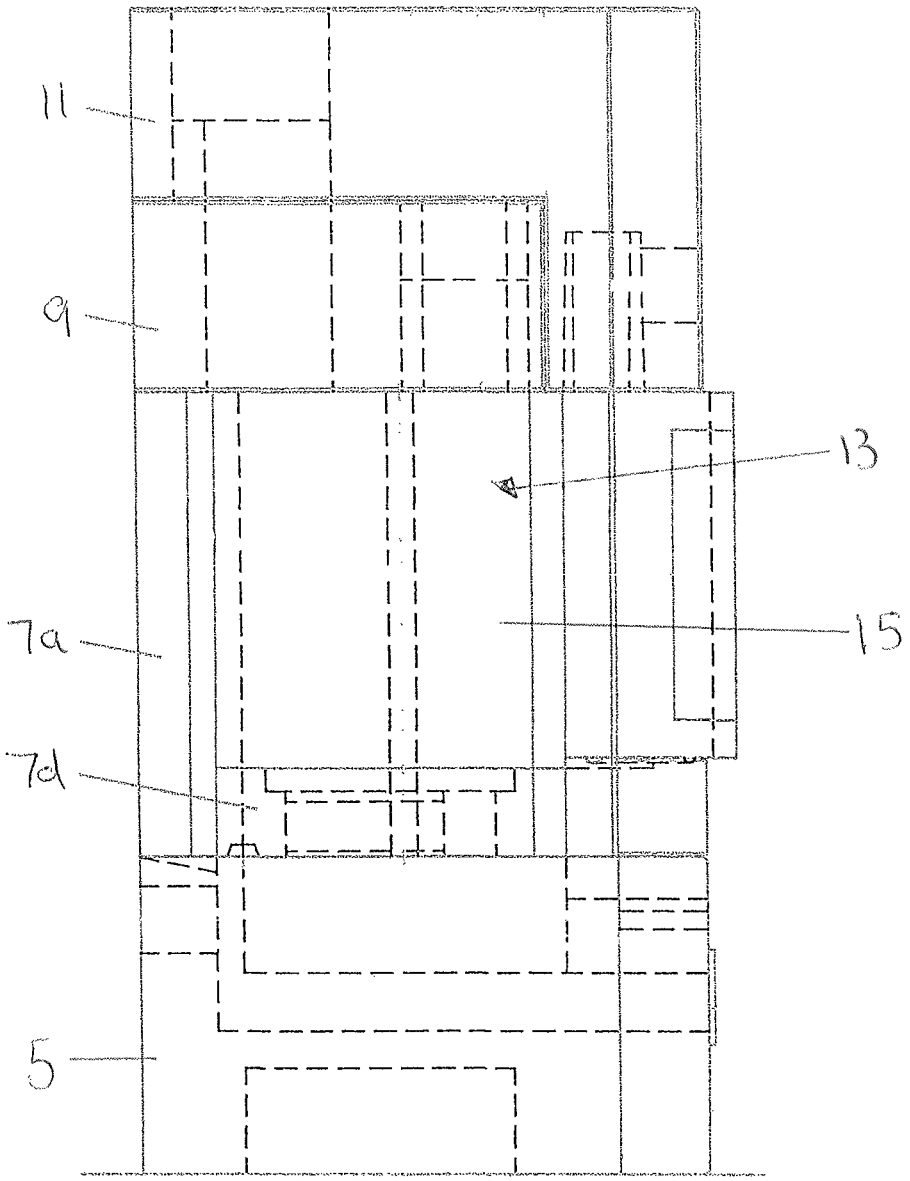
FIG. 2 is a side view of the combustion apparatus shown in FIG. 1.
Figure 3:
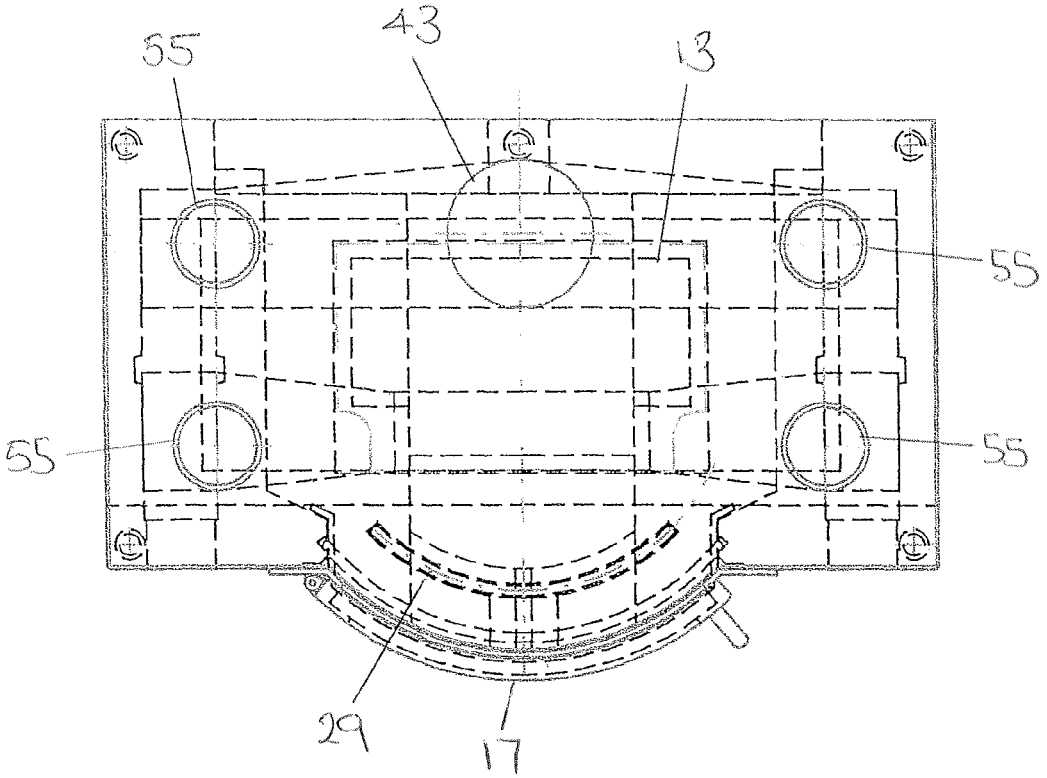
FIG. 3 is a plan view of the combustion apparatus shown in FIG. 1.
Figure 4:
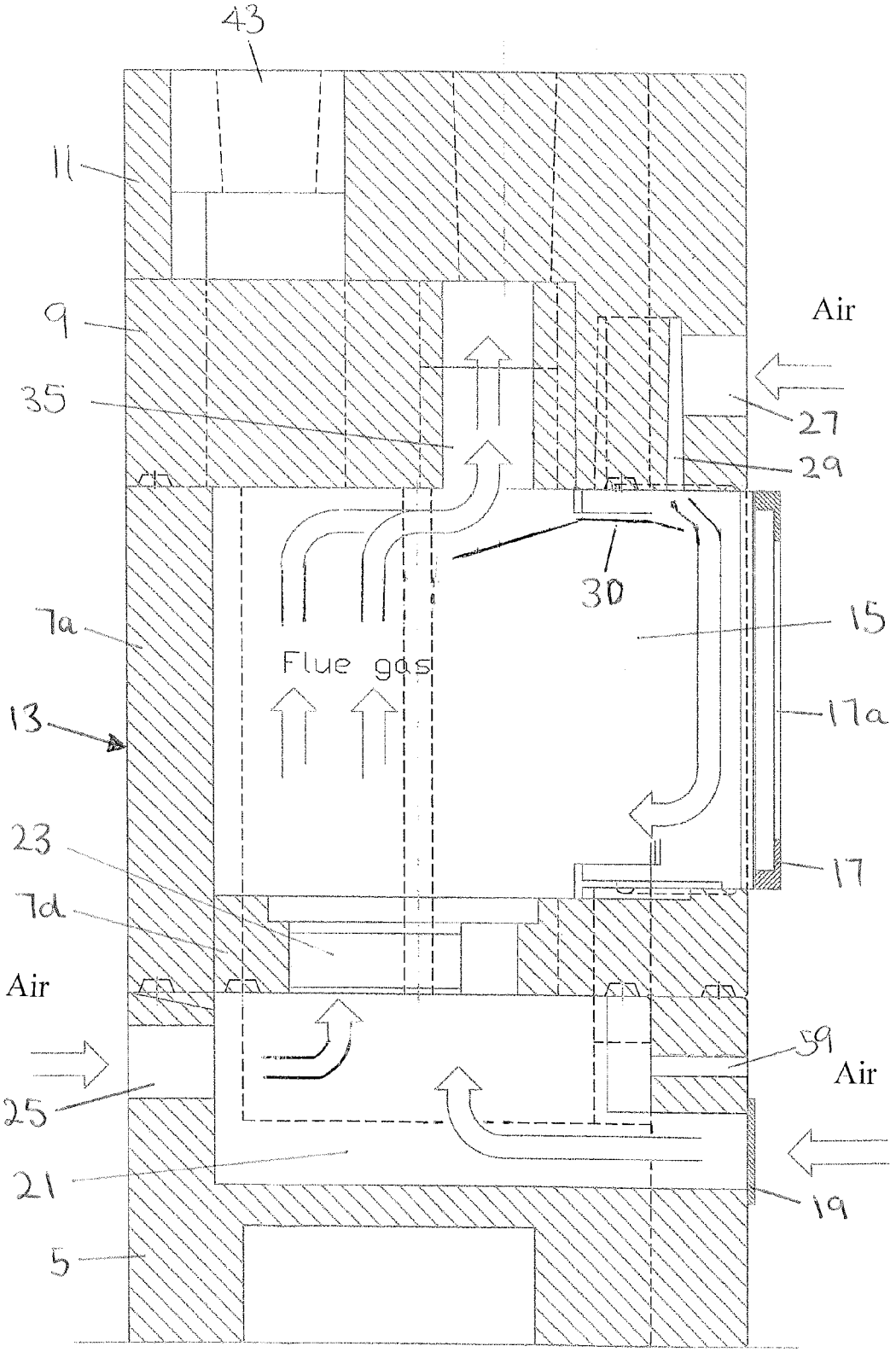
FIG. 4 is a section, to an enlarged scale, on the line A-A of FIG. 1.
Figure 5:
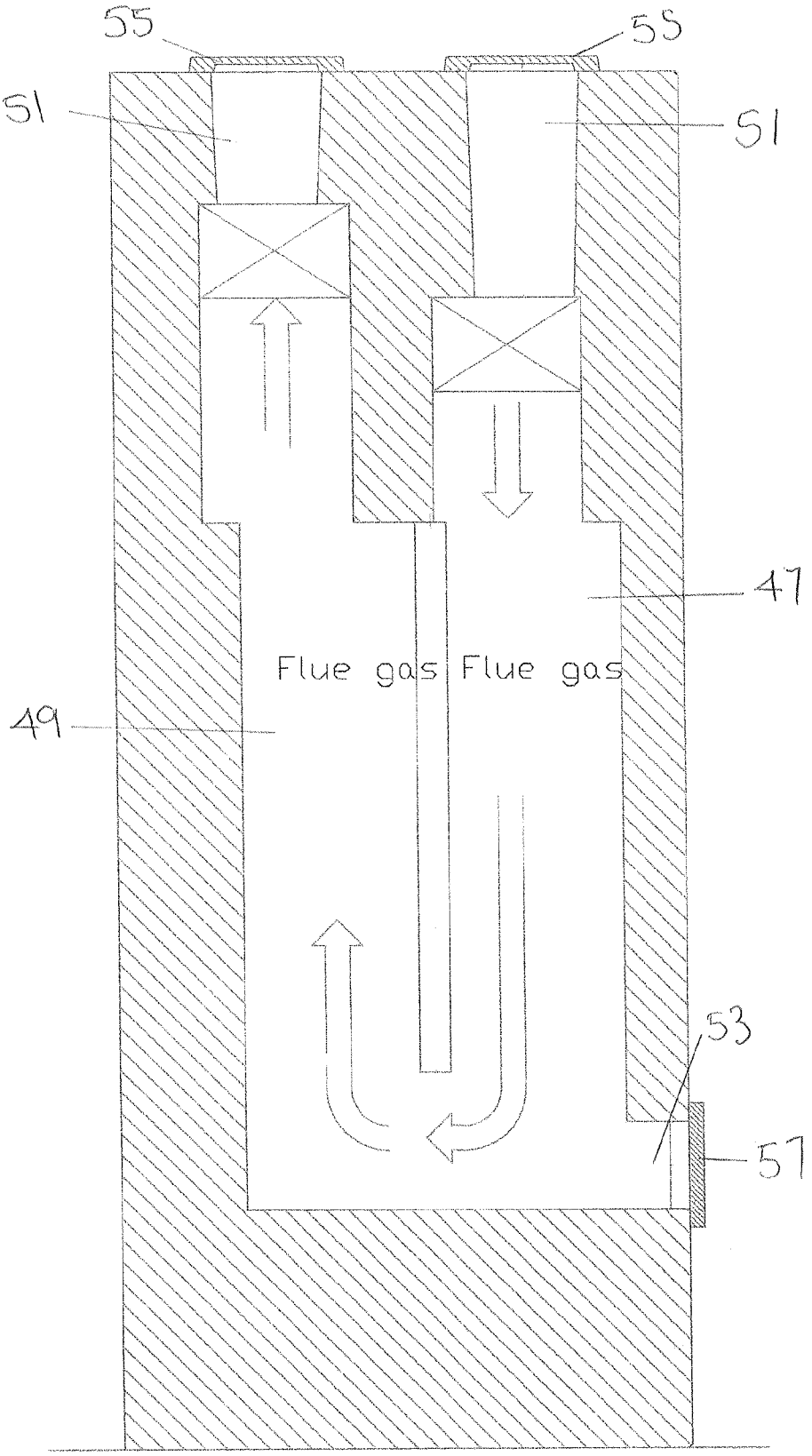
FIG. 5 is section, to an enlarged scale, on the line B-B of FIG. 1.
Figure 6:
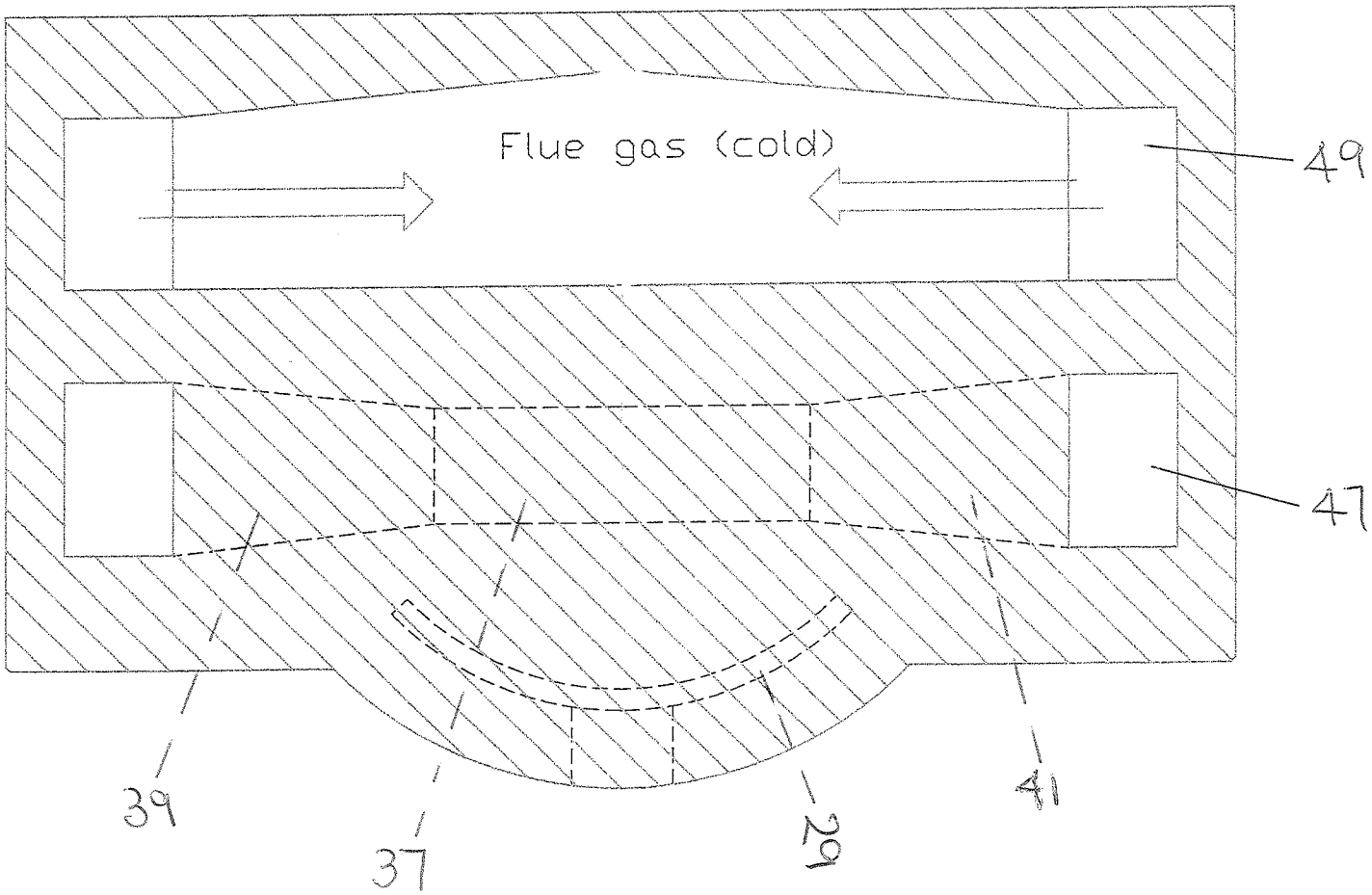
FIG. 6 is a section, to an enlarged scale, on the line C-C of FIG. 1.

Referring first to FIGS. 1 to 7 of the drawings, there is shown combustion apparatus in accordance with the invention in the form of a stove 1 for use with a solid fuel such as wood, coal etc.

The stove 1 comprises a free standing body 3 constructed from blocks of a fired refractory material arranged in sections one on top of the other that are designated a base section 5, a lower intermediate section 7, an upper intermediate section 9 and a top section 11. The number of sections may vary according to the design of the stove 1.

In this embodiment, the base section 5, upper intermediate section 9 and top section 11 each comprise a single block although this is not essential and one or more of these sections may comprise a plurality of blocks. The lower intermediate section 7 comprises a plurality blocks assembled to provide a firebox 13 that defines a combustion chamber 15. The blocks include a rear block 7*a*, a pair of side blocks 7*b*, 7*c* and a base block 7*d*.

The rear block 7*a* forms the back wall of the firebox 13. The side blocks 7*b*, 7*c* form the side walls of the firebox 13. The base block 7*d* forms the bottom wall of the firebox 13 and supports a grate (not shown). The top wall of the firebox 13 is formed by the upper intermediate section 9.

The firebox 13 is closed by a door 17 mounted at the front of the stove 1. The door 17 can be opened to provide access to the firebox 13 for placing solid fuel on the grate in the firebox 13. The door 17 typically includes a heat resistant glass window 17*a* that allows the combustion process within the firebox 13 to be viewed without opening the door 17.

Also mounted at the front of the stove 1 is a door 19 that can be opened and closed to provide access to an ash pit 21 located below the combustion chamber 15.

Combustion air for the primary combustion process is admitted to the combustion chamber 15 through an opening 23 in the base block 7*d* of the upper intermediate section 7 in which the grate (not shown) is seated. The opening is rectangular but this is not essential and the opening 23 may have other shapes. The grate supports solid fuel placed in the combustion chamber 15 and allows ash from the combustion process to fall into the ash pit 21.

The primary air flow to the combustion chamber 15 includes a fixed flow provided by an air inlet port 25 in the rear wall of base section 5 and a variable flow provided by adjusting opening of the door 19. Any other means for providing a variable air flow may be provided.

The inlet port 25 provides a minimum air flow if the door is 19 is closed. More than one air inlet port 25 may be provided. In a modification (not shown), the air inlet port 25 may be omitted.

Combustion air for a secondary combustion process is admitted to the combustion chamber 15 through an air inlet duct 27 leading to a slot 29 that opens to the combustion chamber 15 above the door 17.

The secondary air flow is preheated as it passes through duct 27 and slot 29 and is directed downwards across the inside face of the door 17 by a baffle 30 located at the top of the combustion chamber 15.

The secondary air flow creates turbulence and re-combustion of the combustion products within the combustion chamber 15.

Opening of the duct 27 can be controlled to vary the flow of secondary combustion air to the combustion chamber 15 by a manually operable control member (not shown). The air inlet duct 27 may be closed to prevent admission of secondary combustion air. Any other means for providing a variable air flow may be provided.

The baffle 30 also serves to direct hot combustion products that rise within the combustion chamber 15 to an outlet port 35 at the top of the combustion chamber 15.

The outlet port 35 leads to a passageway 37 that splits into two flow paths 39, 41 that extend either side of the combustion chamber 15 within the body 3 of the stove 1 before recombining to deliver the combustion products to an outlet 43 at the top of the stove 1. The outlet 43 is connected to a flue (not shown) for discharging the combustion products to atmosphere.

Each flow path 39, 41 of the passageway 37 is generally U-shaped with a first leg 47 that receives the combustion products from the combustion chamber 15 and a second leg 49 that delivers the combustion products to the outlet 43.

The first and second legs 47, 49 are arranged vertically within the body 3 of the stove with the first leg 47 towards the front of the stove and the second leg 49 towards the back of the stove 1. In this embodiment, the first and second legs 47, 49 are of rectangular cross-section although this is not essential and other cross-sections may be employed.

The flow paths 39, 41 preferably extend substantially the full height of the body 3. In this way the heat from the combustion products is transferred to substantially the whole of the body 3 of the stove 1. As a result, the temperature of the combustion products is significantly reduced before the combustion products are discharged to atmosphere.

Access to the passageway 37 for cleaning is provided by holes 51 in the top section 11 that open to the upper ends of the legs 47, 49 of the flow paths 39, 41 and by holes 53 in the base section 5 that open to the lower ends of the legs 47, 49 of the flow paths 39, 41. The holes 51 are closed by removable plugs 55 and the holes 53 are closed by removable plugs 57.

Access to the ash pit 21 for a riddling device (not shown) is provided by an opening 59 in the base section 5 above the door 19. The opening 59 is closed by a removable plug 61.

The sections 5, 7, 9, 11 of the body 3 are made of a fired refractory carbide material which preferably includes silicon carbide in an amount of at least 40% by weight, more preferably at least 50% by weight, still more preferably at least 60% by weight and may include up to 90% by weight silicon carbide.

The presence of silicon carbide improves the combustion of the solid fuel in the combustion chamber 15 and the transfer and retention of heat from the combustion gases to the body 3 of the stove 1. As a result, heat extraction is improved and the stove 1 can continue to radiate heat over an extended period of time after the solid fuel has been burnt.

Figure 8:
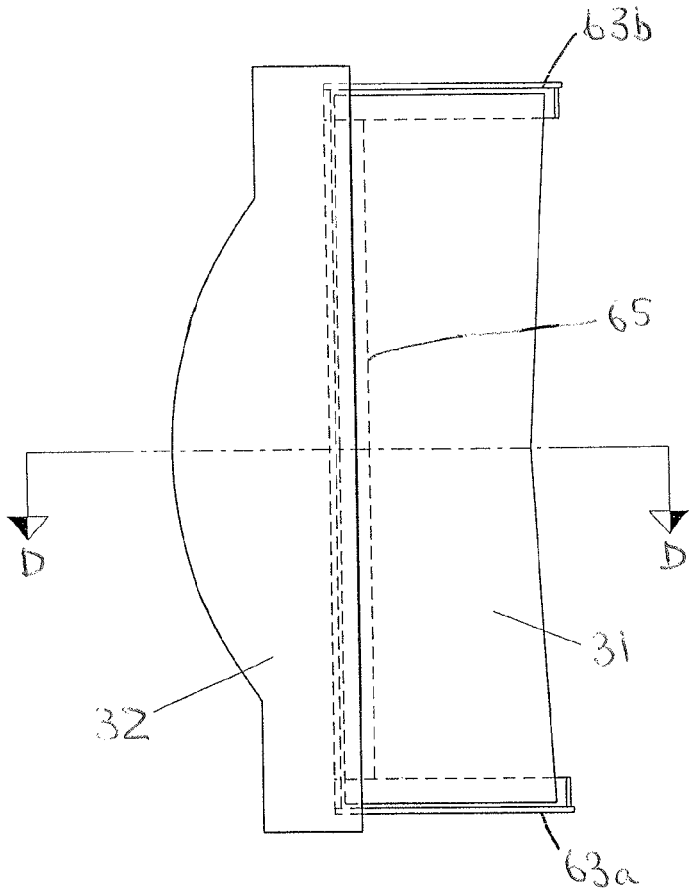
FIG. 8 shows a detail of the baffle shown in FIG. 4.
Figure 9:
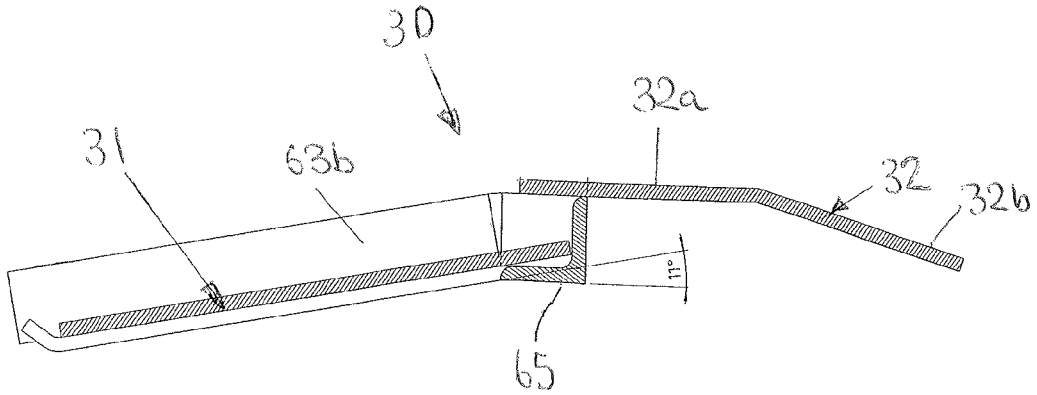
FIG. 9 is a section on the line D-D of FIG. 8.

Referring now to FIGS. 8 and 9 of the drawings, the baffle 30 is shown in more detail.

The baffle 30 comprises two plates 31, 32 configured as shown. The plate 31 extends between two angle bars 63*a*, 63*b* and a further angle bar 65 extends along a front edge of the plate 31. The plate 31 is angled downwardly and extends below the outlet port 35 so that the hot combustion products are directed to flow towards the outlet port 35.

The plate 32 has a first portion 32*a* that extends horizontally and a second portion 32*b* that is angled downwardly below the slot 29 so that the secondary air flow is directed across the inside face of the door 17.

The plates and bars are made of steel or other materials capable of withstanding the operating temperature of the stove.

Figure 10:
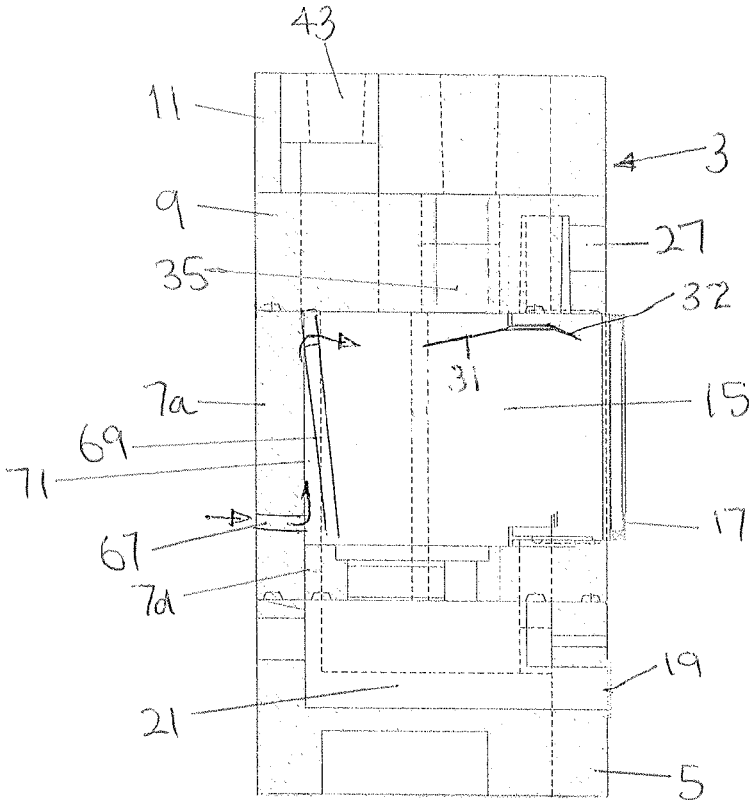
FIG. 10 shows a modification of the combustion apparatus of FIGS. 1 to 9 to include a further baffle.
Figure 11:
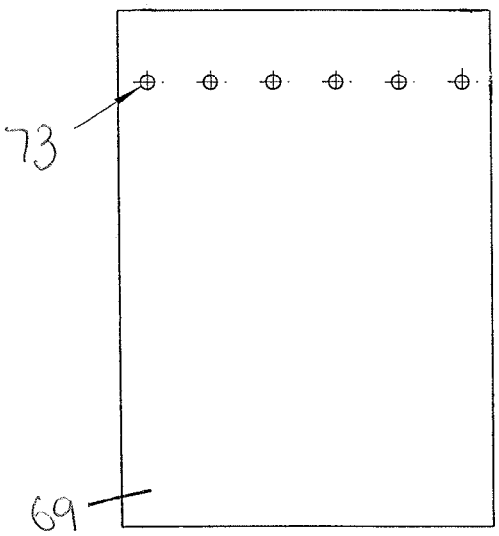
FIG. 11 is a front view of the further baffle shown in FIG. 10.

Referring now to FIGS. 10 and 11, a modification of the combustion apparatus of FIGS. 1 to 7 is shown.

In this modification, an air inlet port 67 is provided in the rear block 7*a* that forms the back wall of the firebox 13 just above the base block 7*d* at the bottom of the combustion chamber 15.

A baffle 69 comprising a rectangular plate of heat resistant material such as steel or vermiculite is provided in the firebox 13 rearwardly of the grate.

The baffle 69 extends from the base block 7*d* to the top of the rear block 7*a* and extends between the side blocks 7*b*, 7*c* to define an enclosed space 71 within the firebox 13 at the back of the combustion chamber 15.

The air inlet port 67 opens to the space 71. The baffle 69 is provided with six circular holes 73 of uniform size and shape towards the upper end.

The number of holes 73 may be varied. The size of the holes 73 may be varied. The shape of the holes 73 may be varied. The holes 73 may be the same or different. The position of the holes 73 may be varied.

Combustion air for a further secondary combustion process is admitted to the lower end of the space 71 through the inlet port 67 and is pre-heated as it flows to the upper end from where it passes into the combustion chamber 15 through the holes 73.

The air flow from the holes causes turbulence and recombustion of the combustion products flowing towards the outlet port 35 at the top of the combustion chamber 15 in a secondary combustion process.

Figure 7:
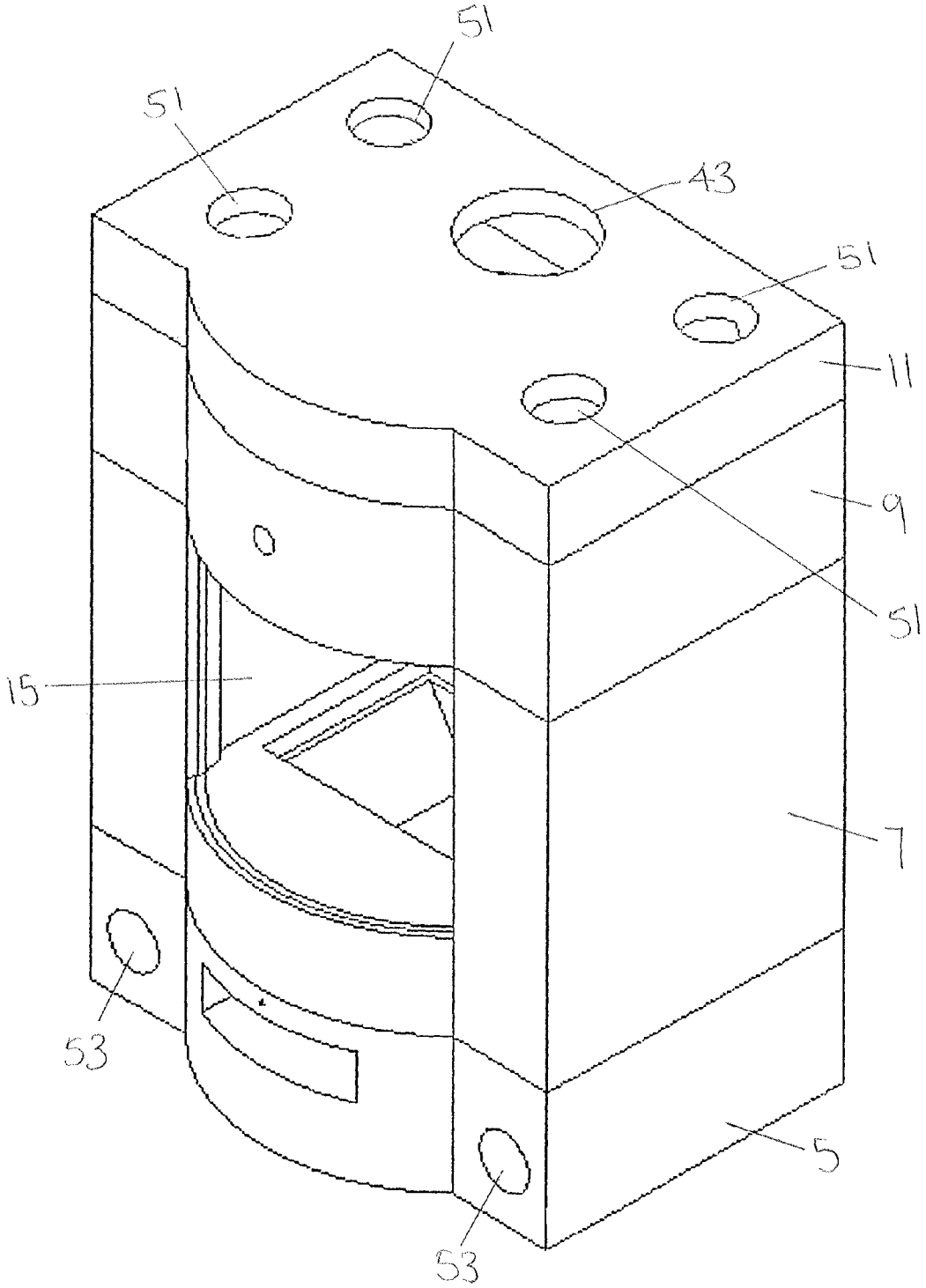
FIG. 7 is a perspective view of the body of the combustion apparatus shown in FIGS. 1 to 6.
Figure 12:
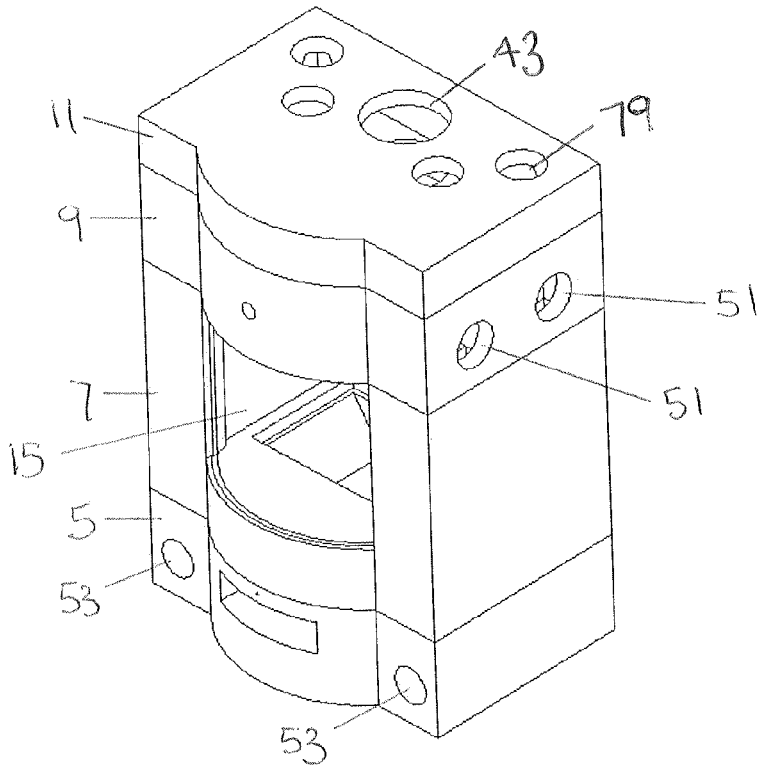
FIG. 12 is a perspective view showing a modification to the body of FIG. 7.
Figure 13:
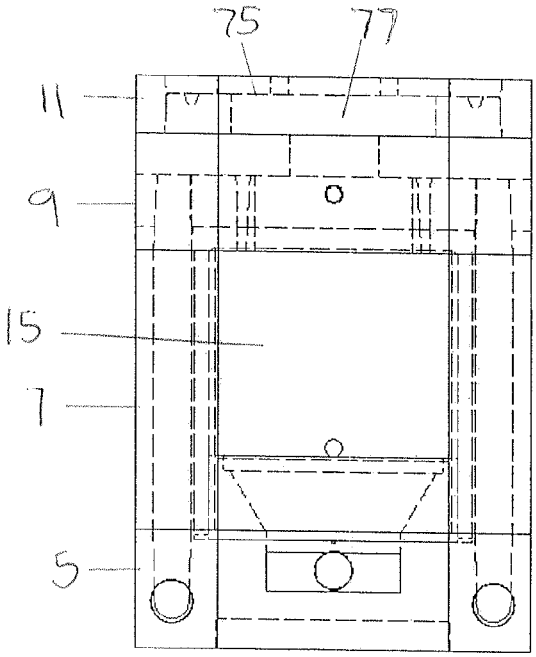
FIG. 13 is a front view of the body shown in FIG. 12.
Figure 14:
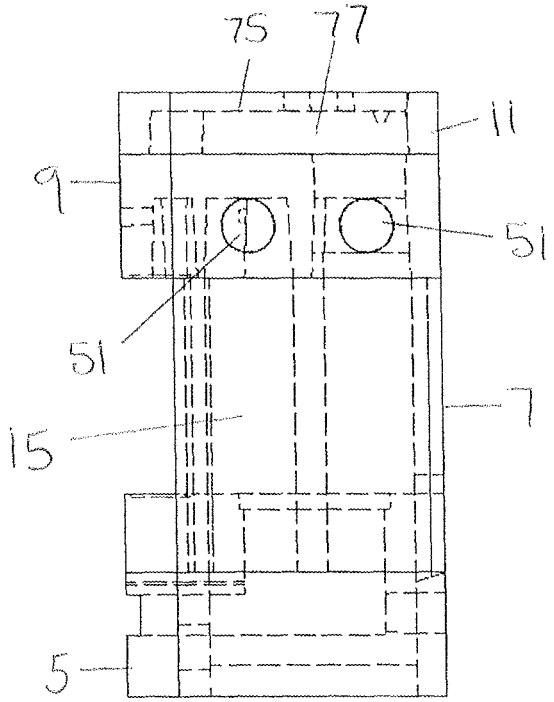
FIG. 14 is a side view of the body shown in FIG. 12.

Referring now to FIGS. 12 to 14, a modification to the body 3 of the combustion apparatus of FIG. 7 is shown.

In this modification, the access holes 51 for cleaning the passageway 37 are provided in the side of the upper intermediate section 9 and the top section 11 is modified to allow heat exchange with a heat transfer fluid.

As shown, the top section 11 is provided with a recessed portion 75 on the underside that defines with the upper intermediate section 9 an enclosed space 77 within the body 3 separate from the combustion chamber 15.

A heat exchange fluid can be circulated through a coil or similar heat transfer device (not shown) located within the space 77 by means of ducting (not shown) connected to the heat transfer device via holes 79 in the top section 11.

The coil is preferably in thermal contact with the body 3 whereby the fluid is heated by heat transfer from the body 3 through the coil.

The heat exchange fluid may be air and the warm air generated may be used for space heating in the room containing the stove and/or in another room.

Alternatively, the heat exchange fluid may be water and the hot water generated may be used for washing or space heating, for example the hot water may be circulated in a hot water system or a central heating system.

It will be understood that the invention is not limited to the embodiments above-described. For example, other constructions for the body are contemplated including both modular constructions employing separate sections as described and monolithic constructions employing a single section may be employed.

In the above-described embodiments, air for the primary and secondary combustion processes is drawn from within the space (room) in which the stove is located. In some applications, it may be desirable to draw air from outside. In this case, ducting may be employed to deliver air drawn from outside to the stove. The ducting may supply air to one or more inlets. Means may be provided to adjust the air flow to any inlet.

Moreover, features of any of the embodiments may be employed separately or in combination with features of any of the other embodiments.

What is claimed is:

1. Combustion apparatus for a solid fuel comprising a stove having a body of fired refractory carbide material defining an outer surface of the stove, the body including a firebox defining a combustion chamber for burning solid fuel wherein the firebox has a top wall, a bottom wall, a back wall and side walls, the back wall and side walls extending between the top wall and bottom wall, and a door for access to the firebox, and wherein the firebox has a primary air inlet, a combustion product outlet in the top wall, a secondary air inlet in the top wall, and a baffle at an upper end of the combustion chamber, the baffle having a front edge spaced from the door and a rear edge spaced from the front edge and from the back wall, wherein the baffle extends below the secondary air inlet for a flow of secondary air from the secondary air inlet past the front edge of the baffle between the front edge of the baffle and the door into the combustion chamber, and wherein the baffle extends below the combustion product outlet for a flow of combustion products past the rear edge of the baffle between the rear edge of the baffle and the back wall to the combustion product outlet, and wherein the combustion product outlet leads to a passageway within the body of the stove for the flow of combustion products from the combustion chamber through the body to an outlet in the body at the top of the stove.

2. Combustion apparatus according to claim 1 in which the fired refractory carbide material includes silicon carbide.

3. Combustion apparatus according to claim 2 in which the fired refractory carbide material contains at least 40% by weight silicon carbide.

4. Combustion apparatus according to claim 3 in which the fired refractory carbide material contains at least 50% by weight silicon carbide.

5. Combustion apparatus according to claim 4 in which the fired refractory carbide material contains at least 60% by weight silicon carbide.

6. Combustion apparatus according to claim 5 in which the fired refractory material contains up to 90% by weight silicon carbide.

7. Combustion apparatus according to claim 1 in which the body is provided with a passageway for a flow of combustion products exiting the combustion chamber to pass through the body from the combustion product outlet to the outlet in the body of the stove for discharge of combustion products from the stove.

8. Combustion apparatus according to claim 7 in which the passageway extends on both sides of the combustion chamber.

9. Combustion apparatus according to claim 1 in which an ash pit is provided below the combustion chamber and is configured to control admission of primary air to the combustion chamber for combustion of a solid fuel with primary air in a primary combustion process in the combustion chamber.

10. Combustion apparatus according to claim 9 in which the ash pit is provided with an air inlet configured to provide a minimum flow of primary air to the combustion chamber and another air inlet configured to provide a variable flow of primary air to the combustion chamber.

11. Combustion apparatus according to claim 1 in which the baffle is arranged to direct the flow of secondary air down across an inside face of the door.

12. Combustion apparatus according to claim 1 in which the body comprises a plurality of sections arranged one on top of the other.

13. Combustion apparatus according to claim 1 in which the firebox has a further secondary air inlet spaced from the rear edge of the baffle at the upper end of the combustion chamber.

14. Combustion apparatus according to claim 7 wherein the passageway provides a flow path having a first portion arranged vertically within the body to receive the flow of combustion products from the combustion product outlet and direct the flow towards a lower end of the body, and a second portion arranged vertically within the body to receive the flow of combustion products from the first portion and direct the flow towards the outlet at the top of the stove.

15. Combustion apparatus according to claim 14 wherein the vertically extending portions of the flow path extend between the upper end of the body and the lower end of the body.

16. Combustion apparatus for a solid fuel comprising a stove having a free-standing body of fired refractory carbide material defining an outer surface of the stove, the body having an outlet at the top of the stove for combustion products exiting the stove, a primary air inlet, and a plurality of secondary air inlets, the body defining a combustion chamber for burning solid fuel and a passageway for a flow of combustion products exiting the combustion chamber through the body to the outlet at the top of the stove, wherein the combustion chamber has a top wall, a bottom wall, a back wall and side walls, the back wall and side walls extending between the top wall and bottom wall, a door for access to the combustion chamber, and a baffle at an upper end of the combustion chamber, the baffle having a front edge spaced from the door and a rear edge spaced from the back wall, wherein a first secondary air inlet is provided in the top wall of the combustion chamber and the baffle extends below the first secondary air inlet whereby a flow of secondary air from the first secondary air inlet flows past the front edge of the baffle and across an inner face of the door towards the bottom wall of the combustion chamber, and wherein the baffle extends below an opening to the passageway in the top wall of the combustion chamber whereby a flow of combustion products flows past the rear edge of the baffle to the opening, and wherein the rear edge of the baffle is spaced from a second secondary air inlet whereby a flow of secondary air from the second secondary air inlet flows towards the baffle for mixing with the flow of combustion products past the rear edge of the baffle.

* * * * *